US005779837A

United States Patent [19]

Harvey

[11] Patent Number: 5,779,837

[45] Date of Patent: Jul. 14, 1998

[54] METHOD OF MANUFACTURING A DROPLET DEPOSITION APPARATUS

[75] Inventor: Robert Alan Harvey, Cambridge, Great Britain

[73] Assignee: Xaar Limited, Cambridge, England

[21] Appl. No.: 596,151

[22] PCT Filed: Aug. 10, 1994

[86] PCT No.: PCT/GB94/01747

§ 371 Date: Mar. 26, 1996

§ 102(e) Date: Mar. 26, 1996

[87] PCT Pub. No.: WO95/04658

PCT Pub. Date: Feb. 16, 1995

[30] Foreign Application Priority Data

Aug. 10, 1993 [GB] United Kingdom ..... 9316605

[51] Int. Cl.[6] ..... B41J 2/16; B41J 2/135

[52] U.S. Cl. ..... 156/153; 156/295; 29/890.1; 347/47; 347/71; 347/72

[58] Field of Search ..... 156/153, 295; 347/47, 71, 72; 29/890.1

[56] References Cited

U.S. PATENT DOCUMENTS 4,879,568 11/1989 Bartky et al. .
4,887,100 12/1989 Michaelis et al. .
4,973,981 11/1990 Bartky et al. .
5,003,679 4/1991 Bartky et al. .
5,017,947 5/1991 Masuda .
5,477,247 12/1995 Kanegae .
5,589,860 12/1996 Sugata et al. ..... 347/71 X

FOREIGN PATENT DOCUMENTS 364136 4/1990 European Pat. Off. .
528440 2/1993 European Pat. Off. .
611154 8/1994 European Pat. Off. .
639551 1/1988 Japan ..... 347/47
2187351 7/1990 Japan ..... 347/47

*Primary Examiner*—Jeff H. Aftergut
*Attorney, Agent, or Firm*—Marshall, O'Toole, Gerstein, Murray & Borun

[57] ABSTRACT

As a step in the manufacture of an ink jet printer, a cover (16) is adhesively bonded to a piezoelectric layer (10) having parallel grooves (20) which will serve as ink channels in the finished printer. Mating surfaces are prepared, excess adhesive is applied and bond pressure exerted until surface extremities of the two surfaces come into contact, producing a bond layer of 2 μm or less. To ensure that the flow distance of excess adhesive is uniform over the bond plane, grooves (32) are cut at the margin (30) of the piezoelectric layer.

24 Claims, 6 Drawing Sheets

METHOD OF MANUFACTURING A DROPLET DEPOSITION APPARATUS

The present invention relates to droplet deposition apparatus and especially to ink jet printheads made of piezo-electric ceramic. In particular it relates to methods for bonding such printheads during assembly. The invention finds particular applications in the manufacture of printheads employing shear mode wall actuators.

For example, in U.S. Pat. No. 5,003,679 (EP-B-0 277 703) there is disclosed a method of making multi-channel pulsed droplet deposition apparatus comprising the steps of forming a base with one or more layers of piezo-electric material, forming a multiplicity of parallel grooves in said base which extend through said layer or layers of piezo-electric material to afford walls of said material between successive channels, locating electrodes in relation to said walls so that an electric field can be applied to effect shear mode displacement of said walls transversely to said channels and securing a top wall to the walls to close said liquid channels.

An alternative example of piezo-electric shear mode ink jet printheads is provided in U.S. Pat. No. 5,016,028 (EP-B-0 364 136), both of the above references being herein incorporated by reference.

A particular feature of a preferred embodiment of the latter reference is that for satisfactory actuation of the actuator walls between channels, the compliance ratio of the bond layer which secures the top wall to the, actuator walls (the compliance ratio is hE/He where h is the thickness of the bond layer, e is the modulus of elastic of the layer, H is the height of the walls and E is the modulus of elasticity of the walls) is less than 1 and preferably less than 0.1. For example, if H=440 μm E=110 GPa and e=5 GPa, the latter value stipulates that approximately the bond layer thickness h<2 μm.

Whilst a variety of techniques exist for bonding piezo-electric ceramic material to other ceramics or to glass and other substrate materials used in ink jet printhead manufacture, the most flexible and convenient technique is often adhesive bonding. The term adhesive is intended to include all suitable glues and cements. However, real difficulties are encountered in providing a uniform adhesive bond layer of thickness 2, μm or less.

It is an object of this invention to overcome some or all of these difficulties in providing an improved method of manufacturing multi-channel pulsed droplet deposition apparatus.

Accordingly, the present invention consists in one aspect in a method of making multi-channel pulsed droplet deposition apparatus comprising the steps in any order of bonding together a stack of layers comprising at least one layer of piezo-electric material and a cover layer; forming a multiplicity of parallel grooves in said stack which extend at least partly through said layer of piezo-electric material to afford walls of said material between successive droplet liquid channels, said channels being closed by said cover layer; and locating electrodes in relation to said walls so that an electric field can be applied to effect shear mode displacement of said walls transversely to said channels; characterised in that the bonding together of two of said layers comprises the steps of preparing respective mating surfaces of said layers to reduce the surface roughness to the order of 2 μm or less; applying an excess of adhesive and with the mating surfaces in register applying pressure and allowing adhesive to flow in the bonding plane until surface extremities of the respective mating surfaces come into substantially direct contact to produce a bond layer of mean thickness 2 μm or less such as 1 μm or less.

By suitably controlled lapping or grinding, it is possible to control the roughness of each of the mating faces so that when they are brought together in contact, in the absence of the bond layer, the surfaces conform so that mean separation between the faces is 2 μm or less. However, when a bond layer of a suitable glue is applied to the surfaces and the surfaces are brought together in contact under pressure, the bond layer builds up hydrostatic pressure inhibiting intimate contact of the mating surfaces and resulting in excessive bond compliance.

Attempts to reduce the problem of hydrostatic pressure by reducing the amount of adhesive which is applied, run the risk of leaving certain regions improperly bonded. The fine scale of the walls and the criticality of the bond in the correct operation of the completed apparatus, compound this problem. In this aspect of the present invention, however, an excess of adhesive is used and pressure is applied until surface extremities of the mating surfaces come into substantially direct contact, with the adhesive filling the interstices. The distance which excess adhesive is required to travel in the bonding plane is preferably kept uniform over the entire interface suitably to a maximum of 100 μm. Where one of the mating surfaces is divided by the parallel grooves into strip portions of 100 μm or less, excess adhesive is permitted to flow into the grooves. It is found that the presence of excess adhesive in the channels of the completed apparatus has no material effect on performance. In other cases, adhesive flow formations are provided at the bond interface to accommodate excess adhesive and to maintain the maximum flow distance.

The invention will now be described by way of example by reference to the attached diagrams in which.

Figure 1:
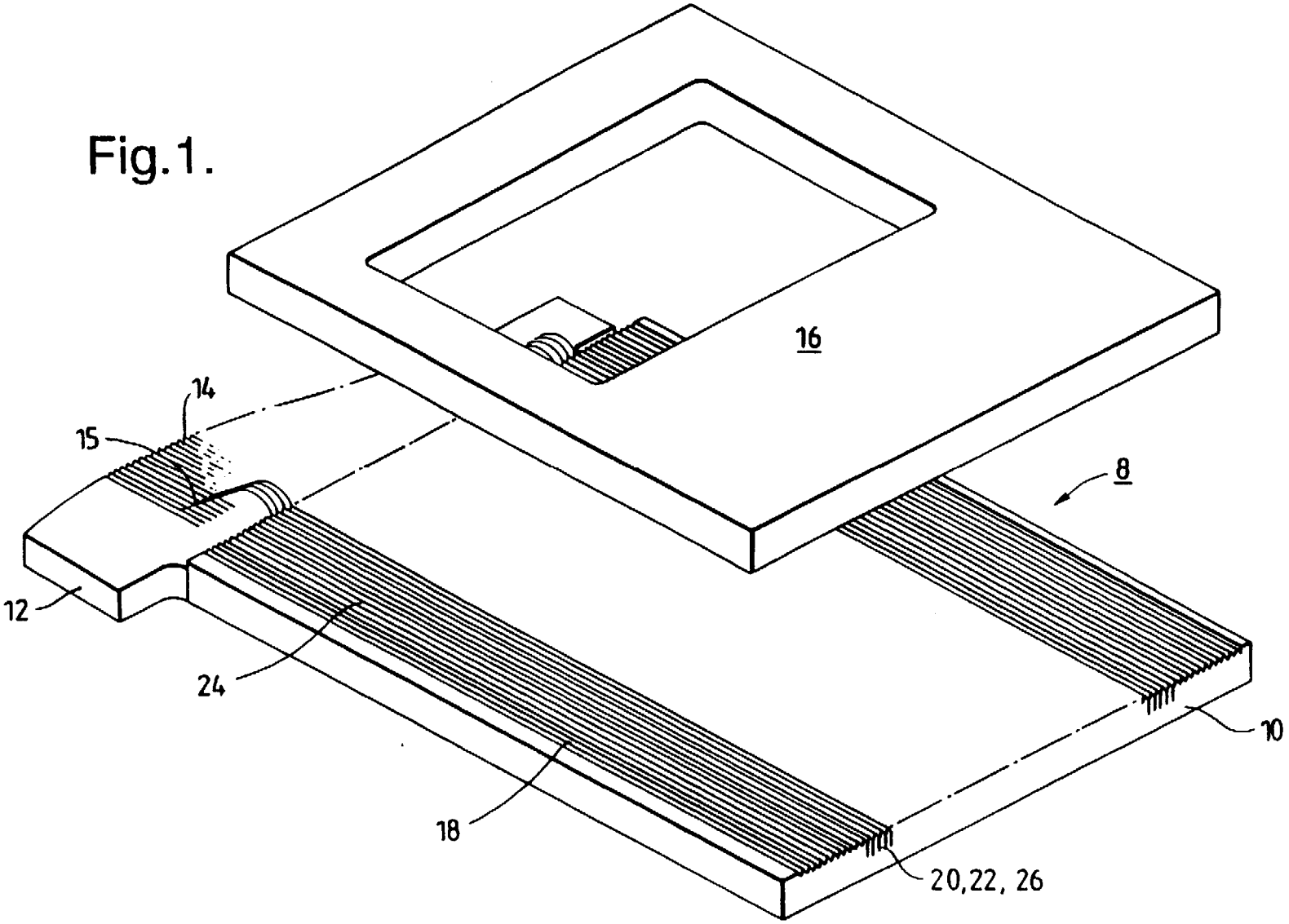
FIG. 1 illustrates an exploded view in perspective of one form of ink jet printhead incorporating shear mode wall actuators.

FIG. 1 shows an exploded view in perspective of an ink jet printhead 8 incorporating piezo-electric wall actuators operating in shear mode. It comprises a base 10 of piezo-electric material mounted on a circuit board 12 of which only a section showing connection tracks 14 is shown. A cover 16, which as will be described later is bonded during assembly to the base 10, is shown above its assembled location. For clarity, the nozzle plate is omitted in the drawings.

A multiplicity of parallel grooves 18 are formed in the base 10 extending into the layer of piezo-electric material. The grooves 18 are formed as described in the above reference U.S. Pat. No. 5,016,028 (EP-B-0 364 136). The base has a forward part in which the grooves are comparatively deep to provide ink channels 20 separated by opposing actuator walls 22. The grooves rearwardly of the forward part are comparatively shallow to provide locations for connection tracks 24. After forming the grooves 18, metallised plating is deposited in the forward part providing electrodes 26 on the opposing faces of the ink channels 20. The plating in the forward part extends over approximately one half of the channel height and in the rearward part provides the connection tracks 24 connected to the electrodes in each channel 20. The tops of the walls separating the grooves are kept free of plating metal so that the track 24 and the electrode 26 in each channel are electrically isolated from other channels.

After the deposition of metallised plating and coating of the base part 10 with a passivant layer for the electrical isolation from ink of the electrode parts, the base 10 is mounted as shown in FIG. 1 on the circuit board 12 and bonded wire connections 15 are made connecting the connection tracks 24 on the base 10 to the connection tracks 14 on the circuit board 12.

Figure 2:
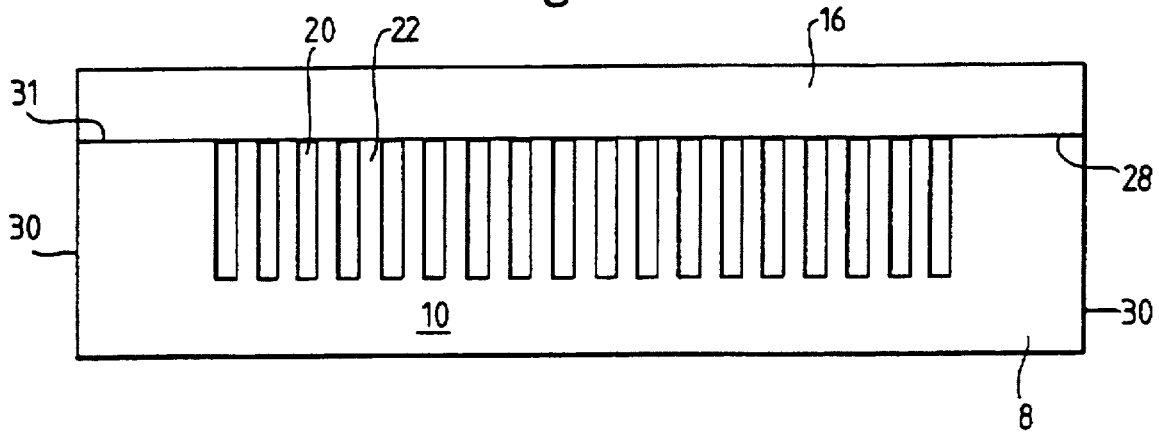
FIG. 2 illustrates a section view normal to the ink channels of the printheads illustrated in FIG. 1 after assembly.

Assembly of the cover 16 by bonding the cover to the base 10 is now described by reference to FIGS. 2 to 5. FIG. 2 shows the cover 16 secured to the tops of the walls 22 in the base 10 by a bond layer 28. A suitable material for bonding is an epoxy resin mix which becomes highly polymerized after curing such as Epotek 353ND. Advantageously, the resin mix may incorporate a silica flour such as Degussa Aerosil R202 to stiffen the bond after curing.

As indicated in the above reference the bond layer 28 is preferably formed with a low compliance so that the actuator walls 22, where they are secured to the cover 16, are substantially inhibited from rotation and shear. The compliance ratio of the bond layer 28, where it secures the actuator walls to the cover (the compliance ratio is hE/He where h is the thickness of the bond layer, e is the modulus of elasticity of the layer, H is the height of the actuator walls and E is the modulus of elasticity of the walls) should be less than 1 and preferably less than 0.1.

By suitably specified lapping or grinding, the roughness of the mating surfaces of the base 10 at the tops of the walls 22 and the cover 16 is controlled, so that when they are brought together under bonding pressure but in the absence of a bond layer, the faces conform so that the mean separation of the surfaces is 2 μm or less. A typical bond pressure in the context of this invention is around 50 atmospheres. When the space separating the faces is filled with the bonding material, which is cured, the bond compliance is then a result of the elastic characteristics of the glue layer. It is generally recognised that very little additional stiffness is contributed by the direct contact between the surface asperities. The problem is, however, that the application of an adhesive layer may result in a bond layer of thickness above the desired minimum.

To ensure complete coverage of the surfaces by glue, it is desirable to apply an excess, as opposed to too thin a layer. When the surfaces are brought together in contact under pressure, the excess glue in regions such as the tops of the walls 22 is found to flow within the surface pores, so that the surfaces come into contact in the surface asperities thereof with a mean separation substantially the same as is obtained in the absence of the bond layer. Excess glue corresponding to a layer 3–5 μm thick spreads into of the adjacent channels and harmlessly coats the channel surfaces.

Figure 3:
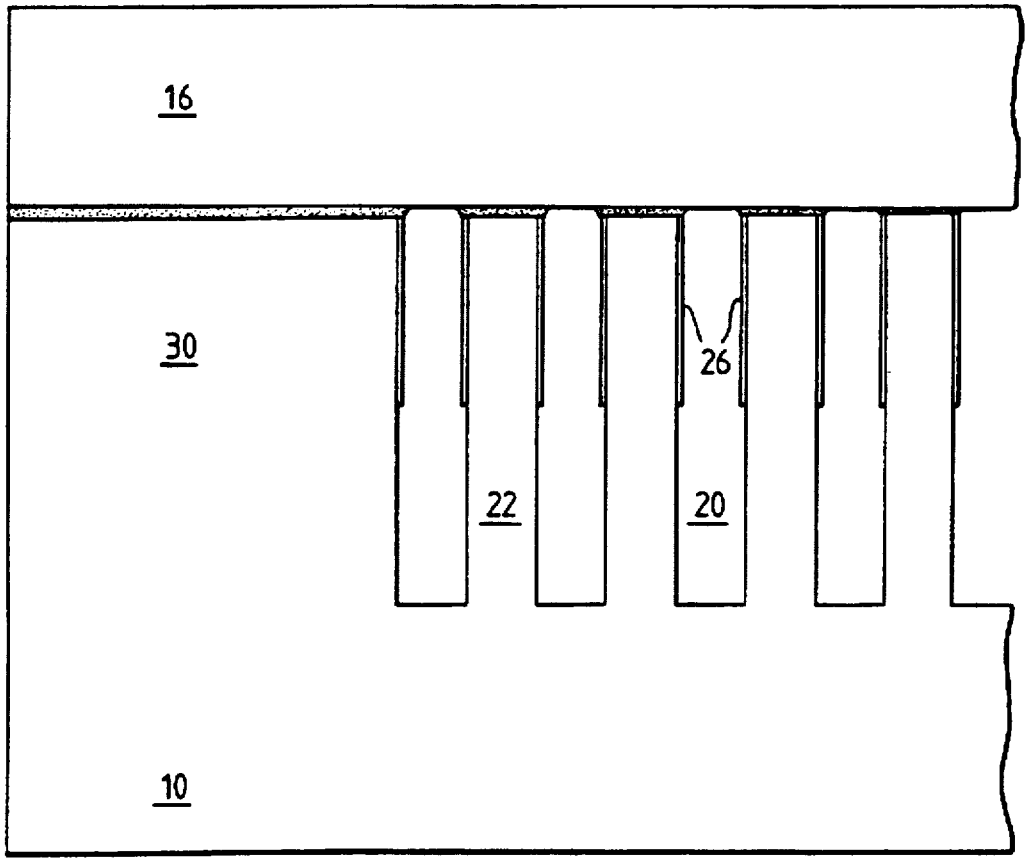
FIG. 3 illustrates a detail of the printhead of FIG. 2 in which one example is shown of the problems to which the invention is addressed.

The problem indicated above arises, for example, when the surfaces between the cover 16 and the lands 31 on outer walls 30 of the printhead are brought together under pressure. The bond layer material between these faces is not readily squeezed out but builds up a hydrostatic pressure, inhibiting the close contact of the mating surfaces. This is partly due to the fact that (for a viscous material) the time to squeeze out the excess layer of bond material varies as the third power of the distance over which the excess material is required to flow. For example, if the outer wall 30 is ten times wider than the actuator walls 22, the required time is one thousand times greater. In addition, the glue may be non-Newtonian, so that the time is even more extended. The required time for the surface to make contact if that result is obtained is not usually available in a mass production process. FIG. 3 illustrates the effects that arise due to the excess glue under the outer wall 30, where not only is the bond layer between the rigid inactive outer wall 30 seen to be thick, but also —due to local flexural rigidity of the cover —the glue film remains thick over a group of actuator walls at the edge of the printhead 10 with the result that the bond compliance at the top of the walls is too great. Such a printhead will therefore have walls that do not pass the test specified in U.S. Pat. No. 4,973,981 (EP-B-0 376 532) or another equivalent test and may be rejected in manufacture.

Figure 4:
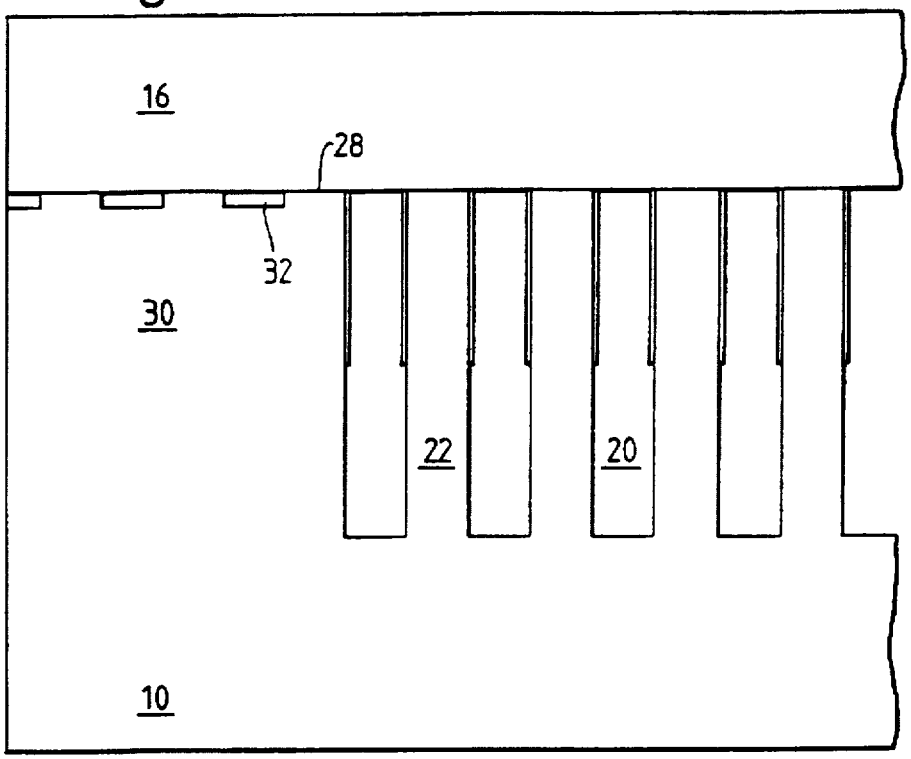
FIG. 4 illustrates one embodiment of the invention which provides a solution to the problem of FIG. 3.

The problem of forming a precisely metered thin glue bond layer over an extended area, such as over the outer walls 30, may be overcome as illustrated in FIG. 4 where a number of shallow grooves 32 are formed on the top of the outer walls 30. These may be formed at the same time as the formation of the channels 20 in the forward part, and may conveniently be formed to a similar depth as the grooves in the rearward part of the wall 10: advantageously they may be of the same width and spacing as the channel grooves 18. Although two such grooves are illustrated, a greater number such as 10, 20 or more grooves may be provided depending on the outer wall width.

One of the mating surfaces is divided by parallel grooves in the surface strip portions of width 100 μm or less and the mating surface may have one or more marginal lands of width significantly exceeding 100 μm and adhesive flow formations may be provided in or opposed to the lands at a spacing of 100 μm or less.

The intention is that the maximum distance which excess adhesive has to travel in the bonding plane over the marginal land 31 is approximately the same distance as over the bulk of the base region, that is to say the thickness of one wall 22.

When excess glue is provided, for example by screen printing of glue on the surface of the base wall 10, and the cover 16 is brought into contact with the base wall under pressure, the grooves 32 formed in the outer wall 30 provide a channel into which excess glue may flow, so that intimate conformity in the region of the outer wall 30 is obtained as readily as on the tops of the actuator walls. Further, if excess glue is provided in the quantity to fill the grooves 32, it can more readily flow along the grooves and escape, avoiding build-up of hydrostatic pressure between the mating parts. It is further more easy to regulate the application of a quantity of glue in excess to ensure successful bond formation, without the deleterious compliance effects to the active walls.

Figure 5:
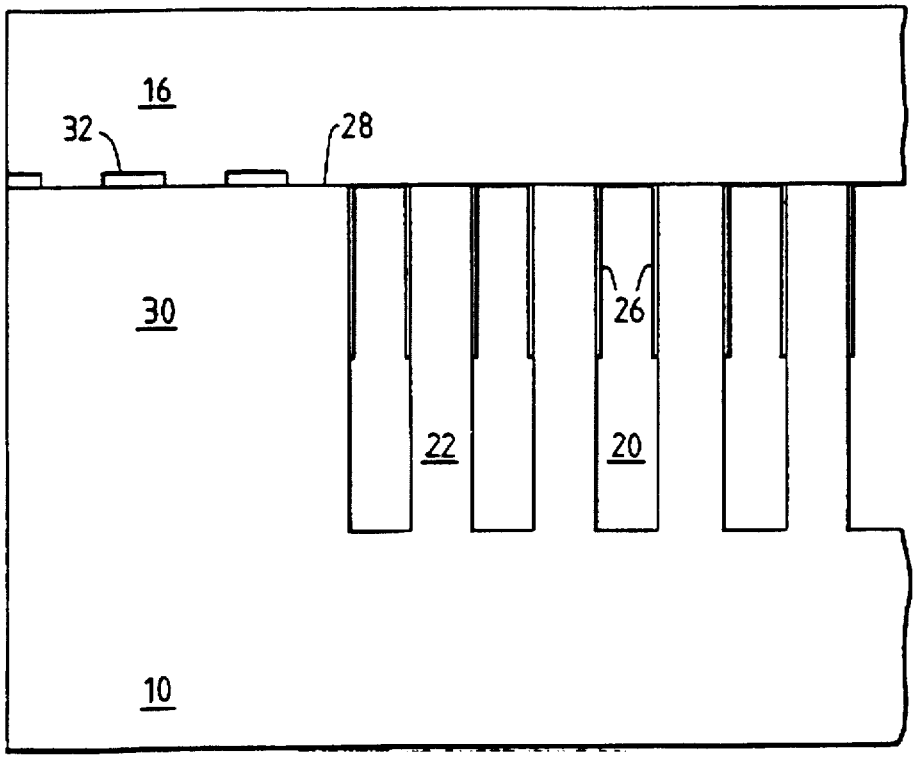
FIG. 5 illustrates an alternative embodiment of the invention which provides a second solution.

An alternative embodiment is illustrated in FIG. 5 in which the grooves, in contrast to being formed in the base wall as described above, are formed in the cover 16. When the cover 16 is made of the same material and by the same process as is the base 10, the grooves are preferably formed in the cover by the same process that employed for manufacture of the base. It may alternatively be preferable to make the cover of different materials or by a different process. For example the cover may be a ceramic formed by powder pressing and firing, it being important to select a material for this process whose thermal expansion coefficient substantially matches that of the piezo-electric ceramic from which the base is made. In that case the grooves in the cover 16 may be formed by indenting the press faces during the pressing operation. The thinness of the bond layer means that the need for matching the thermal expansion coefficients of the materials to be bonded, is particularly acute. Matching to at least 1 ppm is preferred.

The formation of indented features 32 in the cover 16 also places less constraints on the pattern of indentation employed in the region facing the outer wall of the base part. Instead of grooves, indented pits, or crosshatching or any suitable stipple pattern may be adopted which provides adhesive flow formations. It is important that the tops of the patterned regions are ground or lapped or otherwise formed to maintain the specified surface flatness, and that the edge adjacent the outermost channel provides a continuous bonded seal for ink in the outermost channel.

Figure 6:
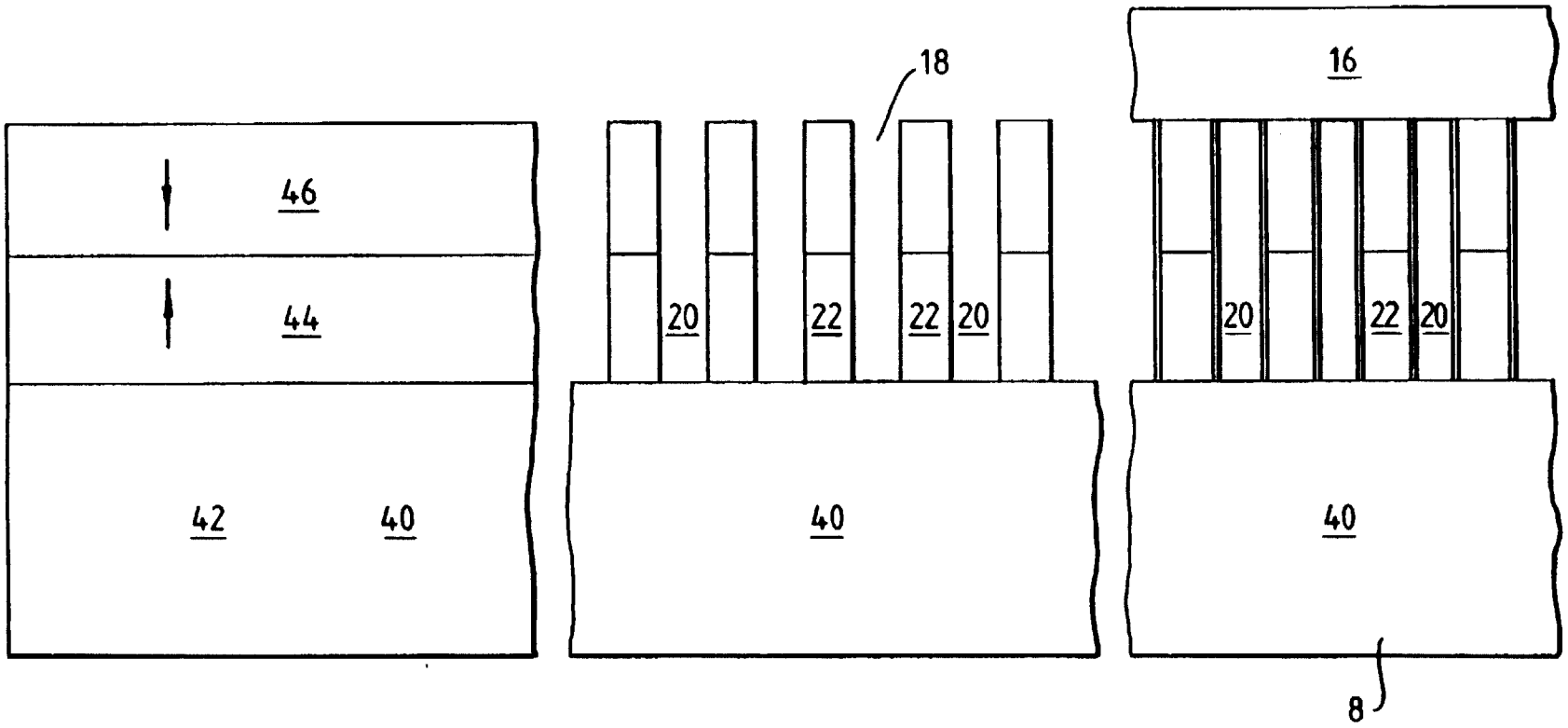
FIGS. 6 and 7 show a laminate wafer comprising three ceramic layers suitable for the manufacture of ink jet printheads incorporating shear mode wall actuators of the chevron design type.

The problem of forming a precisely metered thin glue layer over an extended area similarly arises in forming a bonded piezo-electric laminate wafer 40 as described by reference to FIG. 6 and FIG. 7. The laminate 40 comprises three ceramic layers which are bonded together. The base layer 42 is an insulating ceramic, which in one form is non-piezo-electric. To the base layer are bonded two poled piezo-electric ceramic layers 44 and 46, the poling directions being in anti-parallel as indicated in FIG. 6 in the left hand scrap section.

The laminate is useable for manufacture of ink jet array printheads which employ shear mode wall actuators, of "chevron design" type as disclosed in U.S. Pat. No. 5,003,679 and U.S. Pat. No. 4,879,568 (EP-B-0 277 703) and in U.S. Pat. No. 4,887,100 (EP-B-0 278 590). The laminate is cut through the piezo-electric layers 42 and 44 forming a multiplicity of parallel grooves 18 providing ink channels 20 separated by actuator walls 22. Metallised plating is deposited on the opposing faces of the ink channels as shown in the right hand scrap section, where it extends the full height of the channel walls providing actuation electrodes. The walls are coated with a passivant layer for electrical isolation of the electrode part from ink, and a cover is secured to the top of the walls. Walls of this type being active in both the top and bottom halves are advantageous because they are able to be operated with a lower voltage. Such aspects are described in more detail in the above prior art which are herein incorporated by reference.

Figure 7:
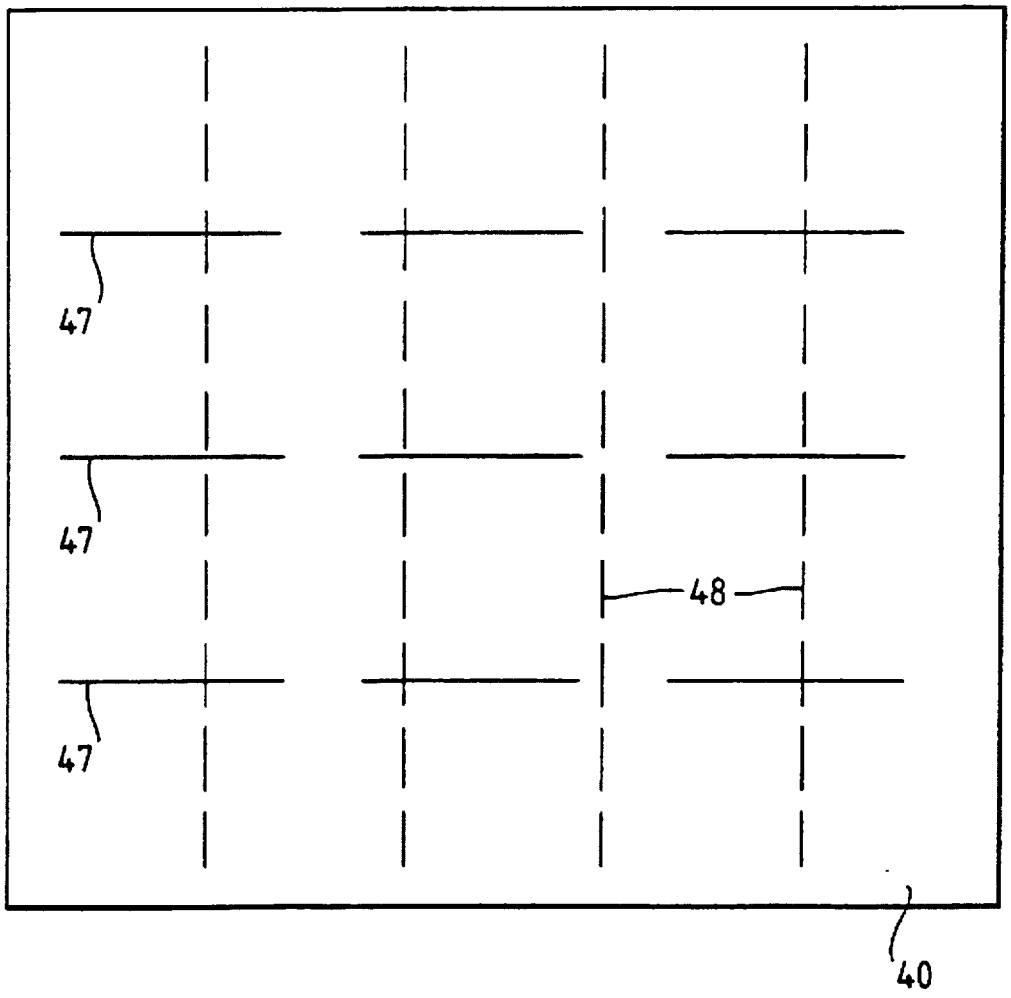

The laminate wafer illustrated in FIG. 7 is formed of three bonded layers as described by reference to FIG. 6 and is of area sufficiently great to provide a multiplicity of ink jet printheads. Twenty are illustrated, but the method of manufacture below is suitable for wafers accommodating any suitable large number of printheads for mass manufacture. Horizontal and vertical lines 47 and 48 show where individual actuators are diced and parted.

As previously indicated, it is important that the bond layers between the ceramic layers 42, 44 and 46 are thin and have a low compliance. This is necessary to ensure that the wall actuators 22, where the layers are bonded one to another, are substantially inhibited from elastic rotation and shear, and that, when subjected to actuation voltages, pressure is efficiently generated in the ink inside the channels in accordance with the voltage actuation pattern.

Suitably controlled surface roughness of the mating surfaces of the ceramic layers 42, 44 and 46 may be obtained by lapping or grinding so that when they are brought together in contact under pressure they touch at the surface asperities and conform with a mean surface separation of 2 μm or less. It is consequently the thickness of the intermediate bond layer between the ceramic layers that governs the bond compliance.

The surface roughness of the mating surfaces can be measured with Talysurf equipment providing a value $R_A$ which is preferably less than 2 μm. It will be recognised that opposing surfaces having each a value $R_A$ of, for example, $\sqrt{2}$ μm are likely to produce, when the surface extremities are in contact, a surface layer of mean thickness approximately 2 μm.

The ratio of a mean thickness of the bond layer in μm to a modulus of elasticity of the bond layer in GPa may be $0.4\times10^{-16}$ $mPa^{-1}$ or less.

Figure 8:
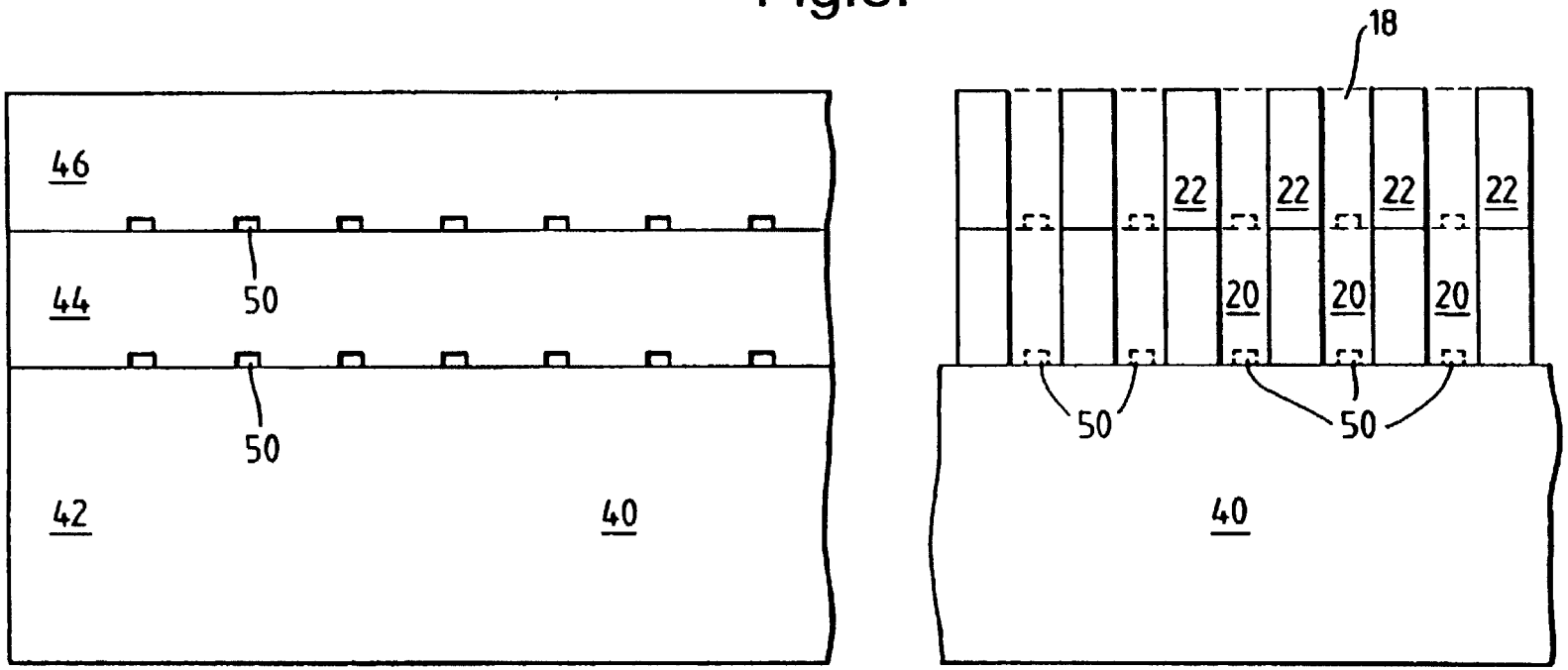
FIG. 8 illustrates how the invention is applied to the formation of the laminate wafer of FIGS. 6 and 7 to reduce the bond compliance between the ceramic layers.

The formation of suitably thin bond layers is achieved as illustrated in FIG. 8, which is a section of the laminate of FIGS. 6 and 7. It is accomplished by providing grooves 50 in one or other of the mating surfaces between each of the ceramic layers parallel to and in the locations of the channels 20. The grooves are located in manufacture by using the edges of the wafer to provide reference edges and are preferably cut narrower than the channels. In regions of a printhead where there are no ink channels, grooves 50 are nevertheless also formed.

When the ceramic layers are coated with glue which is applied in excess and the layers are brought into contact under pressure, the excess glue can flow into and along the grooves so that the tendency to develop substantial hydrostatic pressure in the glue layer during assembly and bonding is avoided and intimate conformity of the ceramic layers is attained. If flow of glue along the grooves 50 in the channel direction is insufficient to avoid the hydrostatic pressure preventing conformity of the layers, cross grooves (not shown) may also be formed in the locations of the part lines 47 or 48, to provide secondary drainage. The volume of the primary grooves 50 in the channel direction however will normally be sufficient to accommodate excess glue and allow conformity of the ceramic layers.

Following bonding of the ceramic layers under pressure, the laminate wafer 40 is cut through the piezo-electric layers 46 and 44 forming grooves 18 as illustrated in FIGS. 6, providing ink channels 20 separated by the actuator walls 22. The locations of the grooves 50 is shown in relation to the ink channels 20 in the scrap section in FIG. 8 on the right as outline grooves shown as dotted lines representing the location of some of the grooves 50 prior to removal of the channel material. The grooves 18 are formed by edge reference of the wafer approximately at the same centres as the grooves 50 so removing the material forming as well as the excess glue in those grooves. The bond compliance of the bond layers forming the wall actuator obtained using the above process is found to be reduced so that the bond compliance ratio satisfies the requirement (hE/He) <0.1 as may be confirmed by resonance tests of the type described in the patent reference U.S. Pat. No. 4,973,981 (EP-B-0 376 532).

I claim:

1. A method of making multi-channel pulsed droplet deposition apparatus comprising the steps in any order of bonding together a stack of layers comprising at least one layer of piezo-electric material and a cover layer; forming a multiplicity of parallel grooves in said stack which extend at least partly through said layer of piezo-electric material to afford walls of said material between successive droplet liquid channels, said channels being closed by said cover layer; and locating electrodes in relation to said walls so that an electric field can be applied to effect shear mode displacement of said walls transversely to said channels; characterised in that the bonding together of two of said layers comprises the steps of preparing respective mating surfaces of said layers to reduce the surface roughness to the order of 2 μm or less; applying an excess of adhesive and with the mating surfaces in register applying pressure and allowing adhesive to flow in the bonding plane until surface extremities of the respective mating surfaces come into substantially direct contact to produce a bond layer of mean thickness 2 μm or less.

2. A method according to claim 1, wherein a flow distance of excess adhesive in the bonding plane is uniform over the bonding plane.

3. A method according to claim 2, wherein one of the mating surfaces is divided by said parallel grooves into surface strip portions of uniform width.

4. A method according to claim 3, wherein said one mating surface has one or more marginal lands of width significantly exceeding the width of said surface strip portions and wherein adhesive flow formations are provided in or opposed to said lands at a spacing substantially equal to the width of said surface strip portions.

5. A method according to claim 1, wherein a maximum flow distance of excess adhesive in the bonding plane is 100 μm.

6. A method according to claim 5, wherein one of the mating surfaces is divided by said parallel grooves into surface strip portions of width 100 μm or less.

7. A method according to claim 6, wherein said one mating surface has one or more marginal lands of width significantly exceeding 100 μm and wherein adhesive flow formations are provided in or opposed to said lands at a spacing of 100 μm or less.

8. A method according to claim 6, wherein said one mating surface has one or more marginal lands of width significantly exceeding the width of said surface strip portions and wherein adhesive flow formations are provided in or opposed to said lands at a spacing equal to the width of said surface strip portions or less.

9. A method according to claim 1, further comprising the steps of forming adhesive flow formations in at least one of said mating surfaces, to accommodate excess adhesive.

10. A method according to claim 9, wherein said adhesive formations comprise parallel recesses at a spacing the same as a spacing of said parallel grooves.

11. A method according to claim 9, wherein said adhesive flow formations and the excess adhesive contained therein are removed in subsequent formation of said parallel grooves.

12. A method according to claim 1, wherein said two layers to be bound are formed of the same material or of different materials having respective thermal coefficients of expansion matched to 1 ppm or better.

13. A method of making multi-channel pulsed droplet deposition apparatus comprising the steps of forming a base with one or more layers of piezo-electric material, forming a multiplicity of parallel grooves in said base which extend at least partly through said layer or layers of piezo-electric material to afford walls of said material between successive channels, locating electrodes in relation to said walls so that an electric field can be applied to effect shear mode displacement of said walls transversely to said channels and bonding a cover to the base to close said liquid channels, characterised in that said bonding comprises the steps of preparing respective mating surfaces of the base and cover to reduce the surface roughness to the order of 2 μm or less; applying an excess of adhesive and with the mating faces in register applying pressure and allowing adhesive to flow between the surfaces until surface extremities of the respective mating surfaces come into substantially direct contact with excess adhesive flowing into said grooves to produce a bond layer of mean thickness 2 μm or less.

14. A method according to claim 13, wherein the base mating surface comprises parallel strip portions defined by said grooves and marginal portions at opposite sides at least one which is of width significantly greater than the width of said strip portions, wherein adhesive flow formations are provided in or opposed to said marginal portion.

15. A method according to claim 14, wherein said adhesive flow formations comprise parallel recesses at a spacing comparable with a spacing of said parallel grooves.

16. A method according to claim 13, wherein the base and the cover are formed of the same material or of different materials having respective thermal coefficients of expansion matched to 1 ppm or better.

17. A method of making multi-channel pulsed droplet deposition apparatus comprising the steps of forming a base laminate through adhesive bonding of a stack of layers comprising at least one layer of piezo-electric material; forming a multiplicity of parallel grooves in said base which extend at least partly through said layer of piezo-electric material to afford walls of said material between successive droplet liquid channels; and locating electrodes in relation to said walls so that an electric field can be applied to effect shear mode displacement of said walls transversely to said channels; characterised in that the bonding together of two of said layers comprises the steps of preparing respective mating surfaces of said layers, providing adhesive flow recesses in one of said mating surfaces and, after the application of excess adhesive, applying pressure between the two layers to cause adhesive to flow into said recesses, said recesses being located at eventual positions of respective ones of said parallel grooves such that the recesses and excess adhesive contained therein are removed in subsequent formation of said grooves.

18. A method according to claim 17, wherein the adhesive flow recesses are positioned and dimensioned so that the flow distance of excess adhesive in the bonding plane is uniform over the bonding plane.

19. A method according to claim 17, wherein said adhesive flow formations are provided at such a spacing that a maximum flow distance of excess adhesive is 100 μm.

20. A method according to claim 17, wherein the step of applying pressure between said two layers causes surface extremities of the two layers to come into substantially direct contact.

21. A method according to claim 17, wherein the bond layer is formed with a mean thickness of 2 μm or less.

22. A method according to claim 17 wherein the bond layer is formed with a mean thickness of 1 μm or less.

23. A method according to claim 17 wherein the ratio of a mean thickness of the body layer in μm to a modulus of elasticity of the layer in GPa is $0.4\times10^{-16}$ $mPa^{-1}$ or less.

24. A method according to claim 17 wherein the step of applying pressure comprises the step of applying pressure at around 50 atmospheres.

* * * * *